US005396682A

United States Patent [19]

Lamprecht

[11] Patent Number: 5,396,682

[45] Date of Patent: Mar. 14, 1995

[54] APPARATUS FOR TRANSPORTING COILER CANS TO AND FROM THE INPUT SIDE OF A FIBER PROCESSING MACHINE

[75] Inventor: Igor Lamprecht, Mönchengladbach, Germany

[73] Assignee: Trüzschler GmbH & Co. KG, Mönchengladbach, Germany

[21] Appl. No.: 41,451

[22] Filed: Apr. 1, 1993

[30] Foreign Application Priority Data

Apr. 10, 1992 [DE] Germany ..... 42 12165.5

[51] Int. Cl.[6] ..... D01H 9/18

[52] U.S. Cl. ..... 19/159 A

[58] Field of Search ..... 19/159 R, 159 A

[56] References Cited

U.S. PATENT DOCUMENTS

| | | | |
|---|---|---|---|
| 3,443,287 | 5/1969 | Hertzch | 19/159 A |
| 3,884,026 | 5/1975 | Yoshizawa et al. | 19/159 A X |
| 4,012,893 | 3/1977 | Weber | 19/159 A X |
| 4,208,768 | 6/1980 | Bonner, Sr. | 19/159 A |
| 4,227,848 | 10/1980 | Kriechbaum et al. | 19/159 A X |
| 4,463,480 | 8/1984 | Oeby et al. | 19/159 A |
| 4,683,619 | 8/1987 | Langen et al. | 19/159 A |
| 5,086,616 | 2/1992 | Günkinger | 19/159 A X |

FOREIGN PATENT DOCUMENTS

| | | | |
|---|---|---|---|
| 0220945 | 5/1987 | European Pat. Off. . | |
| 1104402 | 7/1961 | Germany | 19/159 A |
| 1202194 | 9/1965 | Germany | 19/159 A |
| 0006877 | 1/1983 | Japan | 19/159 A |
| 0937517 | 9/1963 | United Kingdom | 19/159 A |
| 1015240 | 12/1965 | United Kingdom | 19/159 A |

*Primary Examiner*—Clifford D. Crowder
*Assistant Examiner*—Ismael Izaguirre
*Attorney, Agent, or Firm*—Spencer, Frank & Schneider

[57] ABSTRACT

An apparatus for supplying sliver-filled coiler cans to and withdrawing empty coiler cans from an intake track of a sliver-consuming fiber processing machine has a plurality of serially-arranged coiler can changers. Each coiler can changer receives at least three coiler cans in a standby position, a working position and a removal position, respectively. The working positions of the coiler can changers form a row having opposite first and second sides. The standby positions and the removal positions of the coiler can changers are all situated at the first side of the row of working positions. Each coiler can charger further has a drive for simultaneously shifting the three coiler cans thereon to move a first of the three cans from the standby position to the working position and a second of the three cans from the working position to the removal position.

12 Claims, 5 Drawing Sheets

APPARATUS FOR TRANSPORTING COILER CANS TO AND FROM THE INPUT SIDE OF A FIBER PROCESSING MACHINE

CROSS REFERENCE TO RELATED APPLICATION

This application claims the priority of German Application No. P 42 12 165.5 filed Apr. 10, 1992, which is incorporated herein by reference.

BACKGROUND OF THE INVENTION

This invention relates to an apparatus for transporting coiler cans to and from the input side of a sliver-consuming fiber processing machine, for example, a drafting frame. The apparatus has a mechanism for transferring full coiler cans from a standby position to a working position and for transferring the emptied cans from the working position to a removal position. In the working position the coiler cans are arranged at least in one row and sliver is guided from the coiler cans to the fiber processing machine.

As disclosed in Swiss Patent No. 389,461, in a drafting frame which has an intake table, the cans may be transferred from one position to the other by a transversal transporting device which moves simultaneously a plurality of coiler cans from one position to the other. Further, a longitudinal conveying device is provided which shifts the cans along the longitudinal axis of the intake table. Such an apparatus, however, is structurally complex and has the further disadvantage that a doubling of the slivers is fixed by the sequence in which the cans are shifted into place. This is a drawback because such a sequence has to be known and must be observed.

SUMMARY OF THE INVENTION

It is an object of the invention to provide an improved apparatus of the above-outlined type from which the discussed disadvantages are eliminated and which, in particular, is structurally simple and makes possible an amelioration as concerns the doubling of the slivers by the drafting frame.

This object and others to become apparent as the specification progresses, are accomplished by the invention, according to which, briefly stated, the apparatus for supplying sliver-filled coiler cans to and withdrawing empty coiler cans from an intake track of a sliver-consuming fiber processing machine has a plurality of serially-arranged coiler can changers. Each coiler can changer receives at least three coiler cans in a standby position, a working position and a removal position, respectively. The working positions of the coiler can changers form a row having opposite first and second sides. The standby positions and the removal positions of the coiler can changers are all situated at the first side of the row of working positions. Each coiler can charger further has a drive for simultaneously shifting the three coiler cans thereon to move a first of the three cans from the standby position to the working position and a second of the three cans from the working position to the removal position.

By virtue of the fact that the full cans and empty cans are situated on the same side of the cans which are in the working position, any desired sequence of the cans in the working position may be realized. It is a further advantage of the invention that an access is possible to the full cans and the empty cans from the same side, whereby an automation of can conveyance to and from the intake side of the fiber processing machine is significantly facilitated. Also, in contrast to prior art apparatus, according to the invention the sequence of the cans shifted into place need not be observed because for each can support location (can placement) a direct access is possible, and thus, as a result, any desired doubling of the slivers may be effected.

Further additional advantageous features of the invention are as follows: p1 The cans in the standby position and the cans in the removal position are arranged side-by-side in a single row.

A transporting device, for example a carriage, is provided for introducing the full cans into and removing the empty cans from the drafting frame.

The rows of cans in the working position on the one hand and the rows of cans in the standby and removal position on the other hand are arranged parallel to one another.

The cans in the standby position and the cans in the removal position are arranged alternatingly side-by-side.

The cans in the standby position, in the working position and in the removal position are arranged along the longitudinal axis of the intake track (such as an intake table, intake frame, intake trough or the like) of a fiber processing machine, such as a drafting frame.

The cans in the standby position, in the working position and in the removal position are arranged at an oblique angle to the longitudinal axis of the intake track of the fiber processing machine. In this manner, the distances are reduced between the cans in the working position on the one hand and the sliver input side of the fiber processing machine, on the other hand.

The cans in the working position are arranged in a row which is parallel to the row of cans in the standby position and in the working position, and the direction of these parallel rows forms an oblique angle with the longitudinal axis of the intake track.

Each can in the working position is offset relative to the associated full can and empty can.

The transfer (can exchange) from the standby position through the working position into the removal position is effected in a circular path.

The intake side of the fiber processing machine is associated with at least two rotary can changers. It is an advantage of this feature that a rotary transfer of the cans is structurally simpler to realize than a linear transfer.

The rotary can exchangers associated with the intake track are arranged side by side at least in one row.

For each standby position an inlet accumulator is provided to provide for a "reserve" of full cans.

With each removal position there is associated an exit accumulator to provide for a "reserve" of the empty cans.

In a double-row intake track the two rows of cans in the working position are situated at the inside and facing one another and the two rows of cans in the standby and removal position are flanking the can rows in the working position.

Thus, according to the invention, on the intake side of the fiber processing machine (drafting frame) an automatable can intake track is provided. In the apparatus according to the invention the trailing can is not filled but is pulled towards the drafting frame. By the combination of a plurality of individual rotary can changers any desired doubling and practically any can sequence may be realized. The individual rotary can changers are driven by separate motors. Expediently, there may be provided a central drive with corresponding mechanical transmissions to the individual coiler can changers. It is an advantage of the invention that every can transfer and can takeover location is directly accessible. In this manner, any desired sliver mixing for the drafting frame may be effected directly without regard to the can sequence in the transporting carriage. Furthermore, a groupwise or individual can changing may be possible without structural modifications. It is also possible to utilize different can configurations. It is a further advantage that upstream of each can placement an intake accumulator of any desired length (capacity=1 to n cans) may be arranged. The intake accumulator or an intermediate can accumulator may be of modular construction.

FIG. *2a* is a schematic top plan view of a can changing device.

FIG. *2b* is a schematic side elevational view of the device illustrated in FIG. *2a*.

Figure 3:
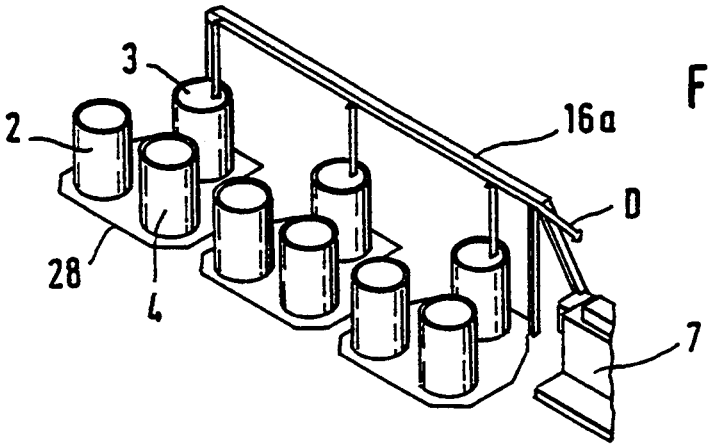

FIG. 3 is a schematic perspective view of the apparatus according to the invention provided at a one-row intake track of the drafting frame.

Figure 4:
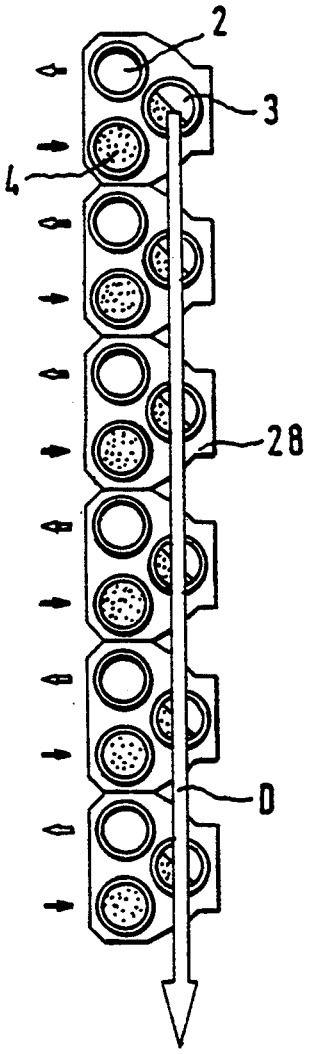

FIG. 4 is a top plan view of the apparatus according to the invention arranged at a one-row intake track of the drafting frame.

Figure 5:
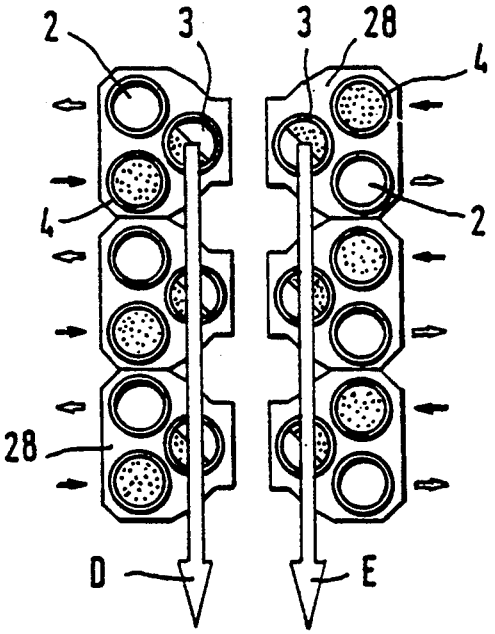

FIG. 5 is a top plan view of the apparatus according to the invention arranged at a two-row intake track of the drafting frame.

Figure 6:
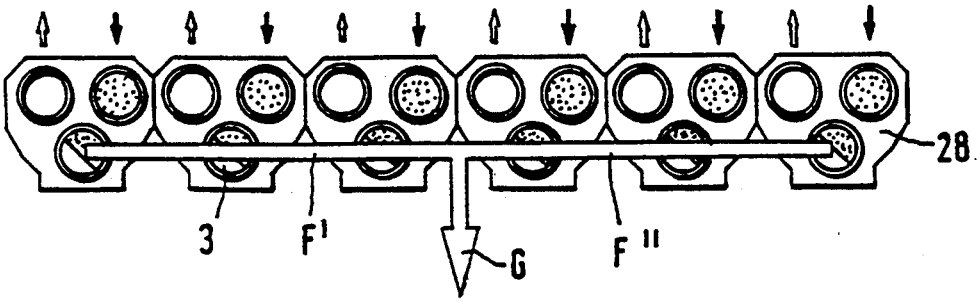

FIG. 6 is a top plan view of the apparatus arranged at a T-shaped intake track of the drafting frame.

Figure 7:
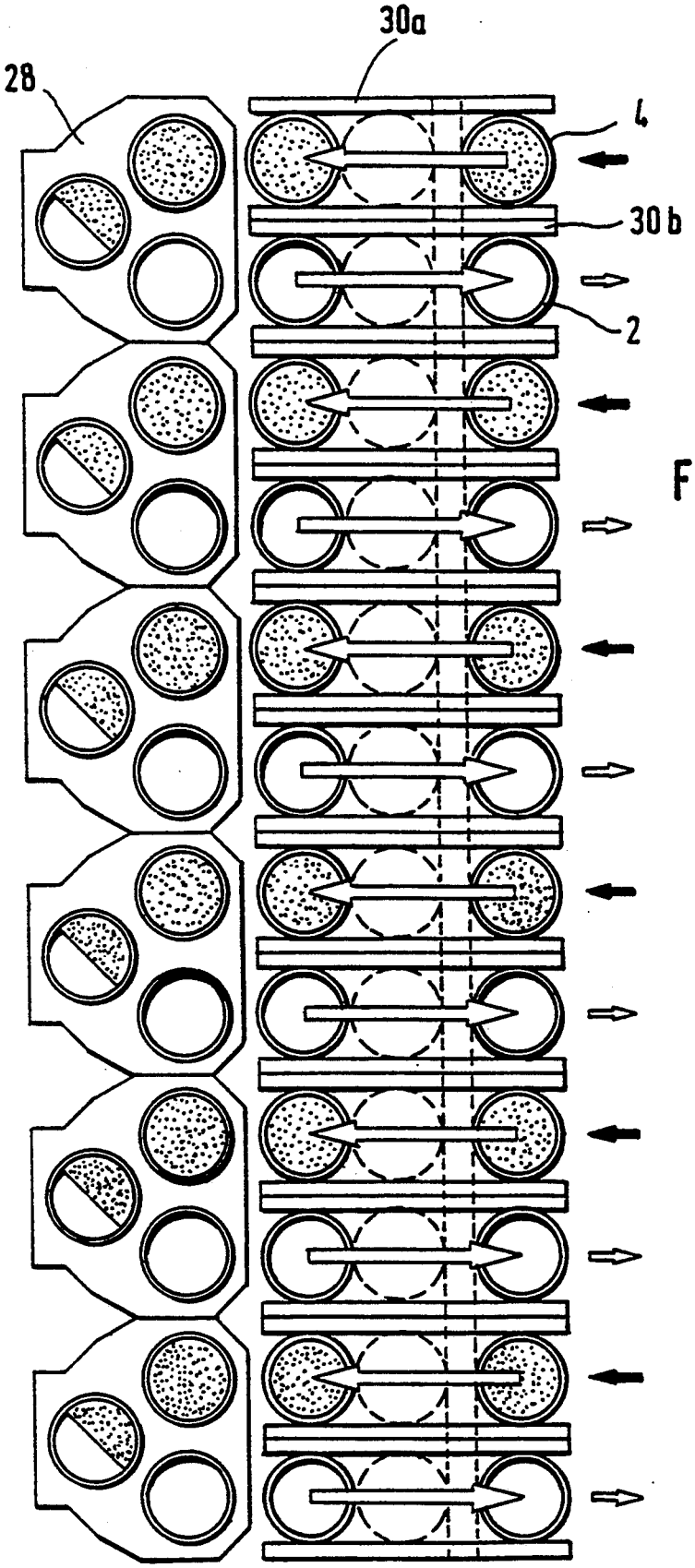

FIG. 7 is a top plan view of the apparatus according to the invention, including inlet and outlet accumulators for the cans.

Figure 8:
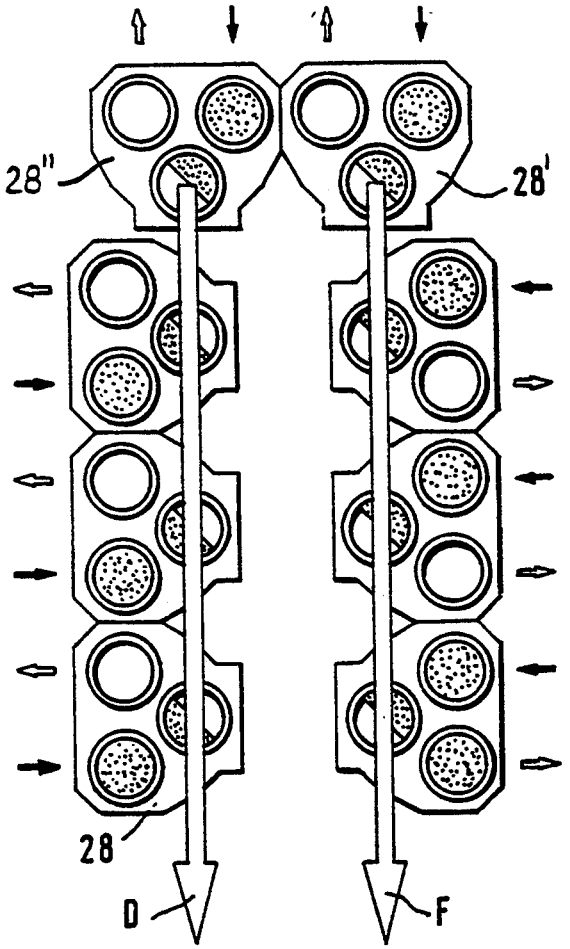

FIG. 8 is a top plan view of the apparatus according to the invention arranged At a U-shaped intake track of the drafting frame.

Figure 9:
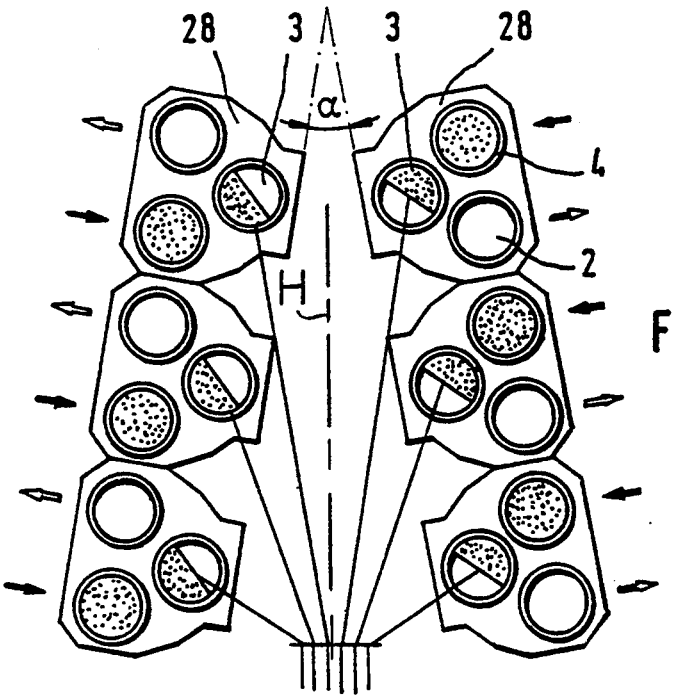

FIG. 9 is a top plan view of the invention arranged at a two-row intake track of the drafting frame, wherein the can rows are arranged at an oblique angle to the longitudinal axis of the intake track.

DESCRIPTION OF THE PREFERRED EMBODIMENTS

Figure 1:
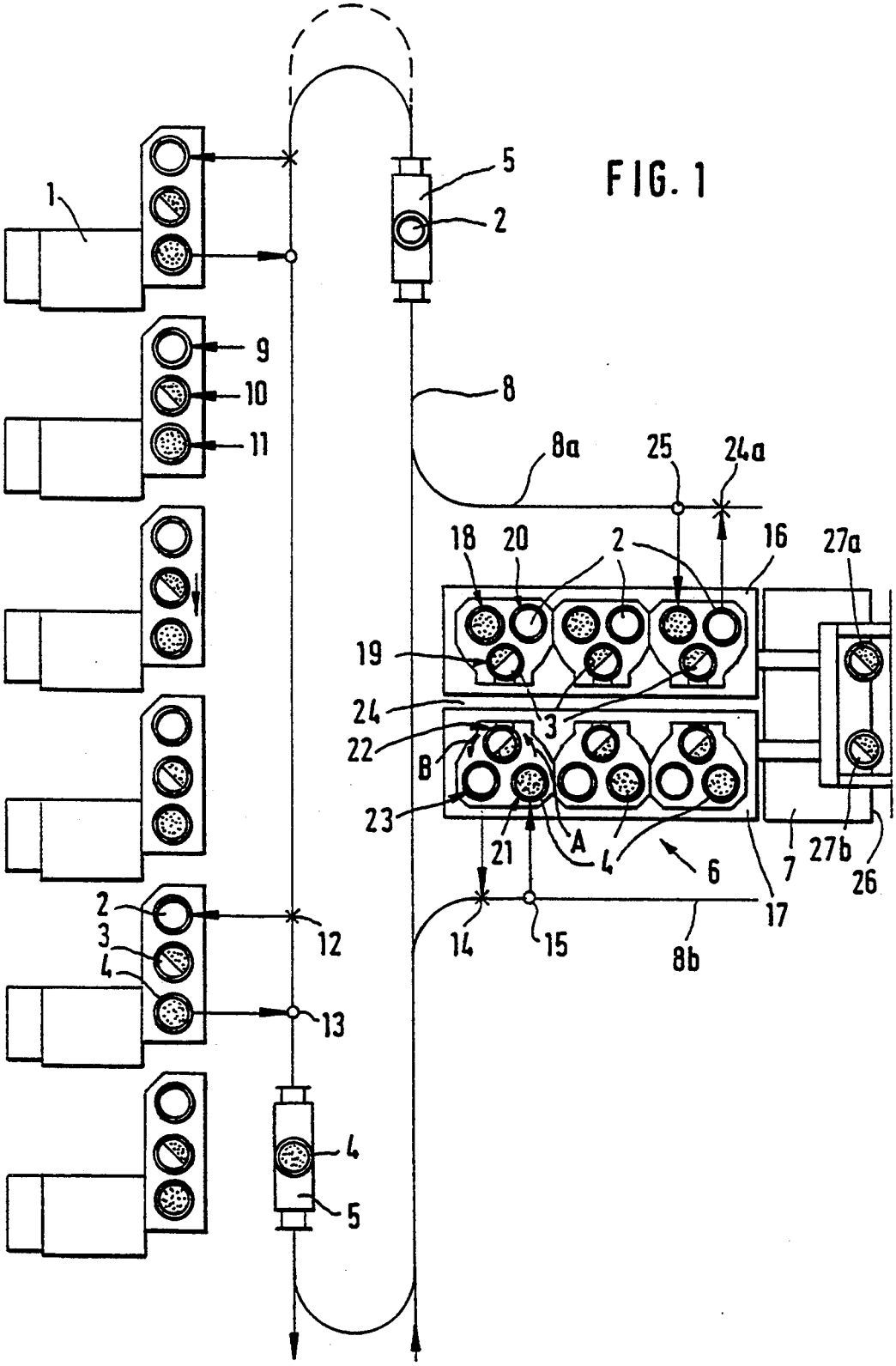
FIG. 1 is a schematic top plan view of a transporting apparatus according to the invention wherein sliver consuming fiber processing machines such as drafting frames are connected with sliver producing fiber processing machines such as carding machines.

In FIG. 1, a plurality of carding machines 1 are schematically shown. The carding machines 1 are arranged in one row, and deliver, at their output side, sliver which is deposited into cans 2 by means of a coiler (not shown). The empty cans 2 are situated in a working position at the output side of the carding machines. The half-filled cans at the outlet end of the carding machines are designated at 3. The full cans 4 are transferred to a transporting device 5 which moves the cans from the carding machines 1 to the input side of a drafting frame 7.

The transporting device 5 which may be, for example, a driverless carriage, has a receiving surface for one or more coiler cans and may travel along a guide track 8. For this purpose, the transporting device 5 has a drive which is controlled by an apparatus not shown. The transporting device 5 has a non-illustrated can-shifting device by means of which the coiler cans are moved onto or out of the transporting device 5.

First the fully charged cans 4 have to be transferred from the working position 10 at the carding machines 1 to the removal position 11. This may be accomplished, for example, by a can changer which is disclosed in German Offenlegungsschrift 29 48 078 and which performs a linear motion. The full cans 4 are then, at the transfer locations 13 in the zone of the carding machines 1, placed onto the carriage 5 by the non-illustrated shifting device carried on the carriage 5. Thereafter, the carriage 5 travels to the intake side 6 of the drafting frame 7, for example, to a transfer location 15.

In the zone of the intake side 6 of the drafting frame 7 there are positioned two intake tracks 16, 17 (each having an intake frame as shown in FIG. 3 at 16*a*), having respective standby positions 18 and 21, working positions 19 and 22 as well as removal positions 20 and 23. In the illustrated embodiment the intake tracks 16 and 17 are each structured to receive three cans 3 arranged in a row in the working positions 19, 22. A service lane 24 is provided between the working positions 19 and 22 of the respective intake tracks 16 and 17.

To transfer, for example, the cans of the intake track 17 from the standby position 21 into the working position 22 as shown by the arrow A or from the working position 22 to the removal position 23 as shown by the arrow B, a rotary can changer is used which will be described in connection with FIGS. *2a*, *2b*.

At the transfer locations 14, 24 in the zone of the respective intake tracks 16, 17, the empty cans 2 are transferred from the removal positions 20, 23 onto the carriage 5. For this purpose the non-illustrated coiler can shifting device mounted on the carriage 5 is utilized. The empty can 2 may be then, by means of the carriage 5, moved to a transfer location 12 arranged at the carding machines 1 and thereafter shifted off the carriage 5 to the standby position 9 in the carding machines 1.

The sliver runs into one or more drafting frames 7 from the coiler cans 3 situated in the working positions 19 and 22 at the intake side 6. At their output side 26 the drafting frames 7 deliver the doubled and reinforced sliver into coiler cans 27*a*, 27*b* which are situated in respective working positions.

The operation of the carriage 5 is controlled by a master computer which sends commands to the control device of the carriage 5 to execute appropriate transporting tasks such as supplying the full or empty cans 4 and 2, respectively, to the standby positions 9, 18, 21 or to transport away the coiler cans from the removal positions 11, 20 and 23 which are provided at the carding machines 1 and at the drafting frame 7.

The master computer is connected with a first signal transmitter situated at the intake side 6 of the drafting frame 7. The first signal transmitter reports when the cans 3 situated at the intake side 6 in the working positions 19 and 22 are about to reach their empty state.

At the standby positions 18, 21 and the removal positions 20, 23 of the intake side 6, sensors are provided which detect the presence of the cans 4 and 2. The sensors too, are connected with the master computer and may be structured as optical barriers, contacts or the like.

In the zone of the output side of the carding machines 1 there are provided additional signal transmitters which indicate when the coiler cans 3 situated in the working position 10 are about to reach their fully charged state. The signal transmitters of the carding machines 1 are in principle structured identically to the signal transmitters of the drafting frame 7. Further, with the standby positions 9 of the carding machines 1 sensors are associated which indicate the presence of coiler cans in the standby position. The sensors may be optical barriers, contacts or the like. The signal transmitters and the sensor of the carding machines 1 are also connected with the master computer.

Figure 2A:
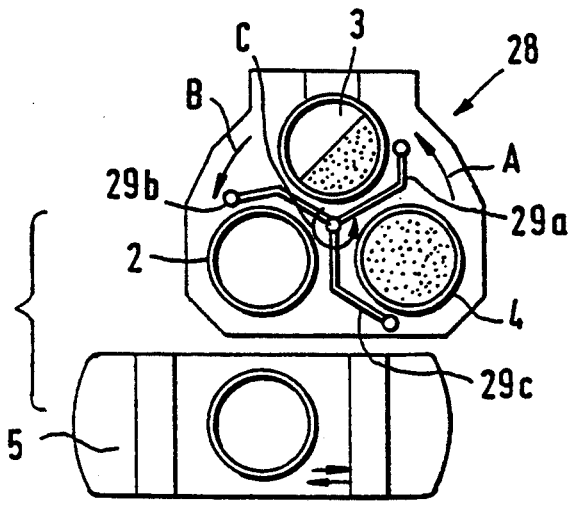
Figure 2B:
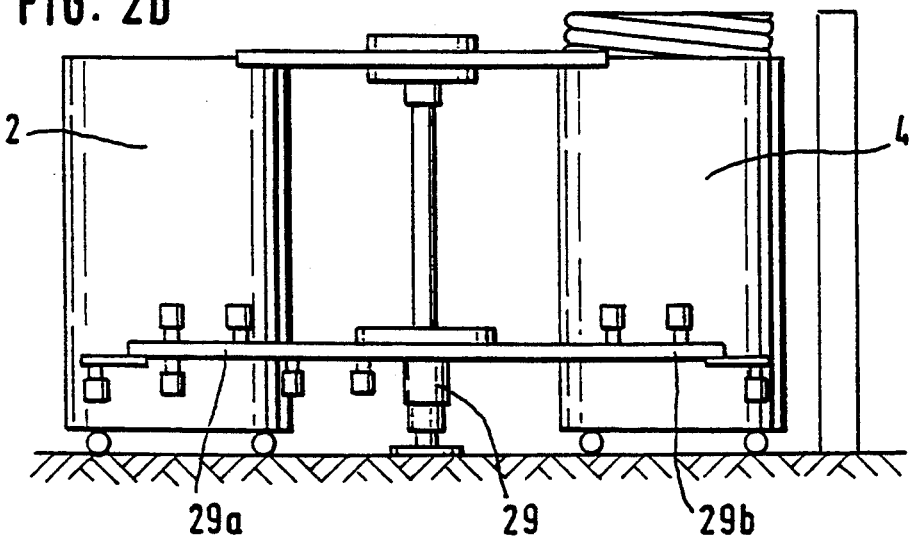

Turning to FIGS. 2*a* and 2*b*, the device 28 for transferring the coiler cans includes a driven rotary cross 29 having three arms 29*a*, 29*b* and 29*c* which straddle a coiler can 2, 3 or 4, respectively. For transferring the cans 2, 3, 4 to or from a working position (such as 19, 22 in FIG. 1), a standby position (such as 18, 21 in FIG. 1) and a removal position (such as 20, 23 in FIG. 1), the rotary cross 29 is rotated 120° in the direction indicated by the curved arrow C, whereby the coiler cans 2, 3 and 4 are carried through 120° to their new position.

Turning to FIG. 3, there is illustrated therein an apparatus according to the invention arranged at a single-row intake track. Three rotary can changers 28 are arranged in a row side-by-side. The intake track (intake frame) is designated at 16*a*. Instead of an intake frame, a positively driven supply table may also be used as the intake track.

According to FIG. 4 which illustrates a single-row intake track, the standby positions supporting the full coiler cans 4 and the removal positions supporting the empty cans 2 alternate with one another and form a single row adjacent the single row of working positions supporting the coiler cans 3 which thus supply sliver to the drafting frames.

Referring to FIGS. 1 and 5, the apparatus according to the invention is arranged at two parallel intake tracks 16 and 17 serving a dual-head drafting frame 7. The full cans 4 are in the standby position 20, 23 and the empty cans are in the removal position 18, 21. The empty and full cans 2, 4 and thus the removal and standby positions are, in an alternating sequence, arranged in single rows for the intake tracks 16, 17, respectively. These cans (and thus the removal and standby positions) are thus on the same side of the respective two rows of cans 3 which are in the working position 19, 22. The arrows D and E indicate the direction in which the slivers are guided from the cans 3 into the drafting frame 7.

In FIG. 6 there is provided an intake track in a T-shaped arrangement. The slivers are first delivered from the cans 3 in a direction F′, F″ which is perpendicular to the drafting frame direction and thereafter are turned 90° to proceed parallel to the drafting frame direction as designated by the arrow G.

As shown in FIG. 7, operationally upstream of each rotary can changer 28 a full-can accumulator 30*a*, and operationally downstream of each rotary can changer 28 an empty-can accumulator 30*b* is provided.

In FIG. 8 the rotary can changers 28 are in a U-shaped arrangement at a two-row intake track. At each head terminus of each intake track a can changer 28 is arranged at a 90° offset as designated at 28′ and 28″.

In FIG. 9, the cans 3 are shown in the working position in a single row which is parallel to the rows of the cans 2 and 4 in the standby and removal position. The direction of the two can rows have an inclined angle to the longitudinal axis H of the intake track.

It will be understood that the above description of the present invention is susceptible to various modifications, changes and adaptations, and the same are intended to be comprehended within the meaning and range of equivalents of the appended claims.

What is claimed is:

1. A combination of a sliver-consuming fiber processing machine with a delivering apparatus for supplying sliver-filled coiler cans to and withdrawing empty coiler cans from the processing machine;

said processing machine comprising an intake track including positioning means for simultaneously supporting a plurality of coiler cans in a working position in which sliver is taken from the coiler cans by the processing machine;

said delivering apparatus comprising a plurality of coiler can changers arranged in a series on said intake track of said processing machine; each coiler can changer including (a) coiler can receiving means for receiving at least three coiler cans in a standby position, a working position and a removal position, respectively; the working positions of said coiler can changers forming a row having opposite first and second sides; said standby positions and said removal positions of said coiler can changers being situated at said first side of said row of working positions; said standby positions and said removal positions together forming a single row extending along the row of said working positions; said coiler can receiving means of the coiler can changers together forming said positioning means of said intake track; and (b) drive means for simultaneously shifting the coiler cans thereon to move one of the cans from the standby position to the working position and another of the cans from the working position to the removal position.

2. The combination as defined in claim 1, further comprising a carriage movable to and away from said coiler can changers for supplying a sliver-filled coiler can to the standby position of each said coiler can changer and for removing an empty coiler can from the removal position of each said coiler can changer.

3. The combination as defined in claim 1, wherein said coiler can changers are arranged in a single row.

4. The combination as defined in claim 1, further comprising a full-can accumulator disposed adjacent the standby position of at least one of said coiler can changers.

5. The combination as defined in claim 1, further comprising an empty-can accumulator disposed adjacent the removal position of at least one of said coiler can changers.

6. The combination as defined in claim 1, wherein in each said coiler can changer the working position is situated out of alignment with the standby position and the removal position as viewed along a line oriented perpendicularly to said row of working positions.

7. The combination as defined in claim 1, wherein said coiler can changers include means for shifting the coiler cans in a circular path.

8. The combination as defined in claim 1, wherein said standby positions and said removal positions are arranged in an alternating series.

9. The combination as defined in claim 1, wherein said intake track has a longitudinal axis; further wherein said row of working positions and said row of standby and removal positions are oriented at an inclined angle to said longitudinal axis of said intake track.

10. The combination as defined in claim 1, wherein said intake track has a longitudinal axis; further wherein said row of working positions and said row of standby and removal positions are oriented parallel to said longitudinal axis of said intake track.

11. The combination as defined in claim 1, wherein the row of working positions and the single row of standby and removal positions are parallel to one another.

12. The combination as defined in claim 11, wherein said intake track has a longitudinal axis; further wherein said row of working positions and said row of standby and removal positions are oriented at an inclined angle to said longitudinal axis of said intake track.

* * * * *